United States Patent [19]

Makal et al.

[11] Patent Number: 4,722,694

[45] Date of Patent: Feb. 2, 1988

[54] HIGH VOLTAGE CABLE CONNECTOR

[75] Inventors: John M. Makal, Menomonee Falls; Randall R. Schoenwetter, Waukesha, both of Wis.

[73] Assignee: RTE Corporation, Waukesha, Wis.

[21] Appl. No.: 936,194

[22] Filed: Dec. 1, 1986

[51] Int. Cl.[4] ..... H01R 13/55

[52] U.S. Cl. ..... 439/181; 439/279; 439/610; 439/921

[58] Field of Search ..... 339/60 R, 75 R, 61 R, 339/92 R, 111, 72 R, 143 R

[56] References Cited

U.S. PATENT DOCUMENTS

| | | | |
|---|---|---|---|
| 3,670,287 | 6/1972 | Keto | 439/186 |
| 3,713,077 | 1/1973 | Leonard | 339/111 |
| 3,883,208 | 5/1975 | Sankey et al. | 339/60 R |
| 3,917,374 | 11/1975 | Murdock | 439/586 |
| 4,116,515 | 9/1978 | Spicer | 439/181 |
| 4,202,591 | 5/1980 | Borgstrom | 339/143 R |
| 4,222,625 | 9/1960 | Reed | 339/111 |
| 4,289,199 | 9/1981 | McGee | 439/279 |
| 4,353,611 | 10/1982 | Siebens et al. | 439/921 |
| 4,354,721 | 10/1982 | Luzzi | 439/921 |
| 4,629,277 | 12/1986 | Boettcher et al. | 439/181 |

*Primary Examiner*—Gil Weidenfeld
*Assistant Examiner*—Paula A. Austin
*Attorney, Agent, or Firm*—James Earl Lowe, Jr.

[57] ABSTRACT

A connector for electrically connecting a high voltage cable to an electrical apparatus bushing with a threaded opening, the connector comprising a housing having a passage having one end formed to sealingly engage the bushing, and an electrically conductive cable connecting element positioned in the housing and extending partially into the first passage. The cable connecting element is adapted to be electrically connected to the high voltage cable. The connector also includes a bushing connecting member mounted in the passage and adapted to be rotated. The connecting member includes a body portion electrically connected to the cable connecting element, and a threaded portion connected to the body portion and adapted to engage the threaded opening in the bushing. The bushing connecting member also includes a lead portion connected to the threaded portion and having such an axial length and a diameter significant to insure the maximum amount of possible misalignment between the bushing threaded opening and the bushing connecting member is at most about one-half a degree. The threaded portion also has a blunt lead thread and the axial length of the threaded portion is of sufficient length so that the threaded portion engages the bushing opening before the connector housing contacts the bushing.

14 Claims, 6 Drawing Figures

HIGH VOLTAGE CABLE CONNECTOR

BACKGROUND OF THE INVENTION

This invention relates to a connector for electrically connecting a high voltage cable to an electrical apparatus bushing with a threaded opening.

In high voltage electric utility circuits, especially in underground systems, it is necessary to make connections between the high voltage cables and various electrical apparatus, such as padmounted switchgear and padmounted transformers. Typically, the connection is made through the use of a connector on the end of the cable and a bushing on the electrical apparatus. A secure connection between the connector and the bushing is necessary.

Because it is hard to maneuver the stiff high voltage cable while attempting to connect the cable connector to the bushing, it is difficult to accomplish the connection.

Many different methods have been used for securing the connector to the bushing. This invention relates to such connections which utilize a threaded connecting member housed in the connector, which connecting member is threaded into a threaded opening in the bushing by rotating the threaded member. Examples of connectors including such threaded connecting members include U.S. Borgstrom Pat. No. 4,202,591 and U.S. Sankey et al Pat. No. 3,883,208; which is hereinafter incorporated herein by reference.

A problem encountered with these connector designs has been in getting the threaded connecting member secured in the threaded bushing opening without stripping the threads on the connecting member. Although some connector designs have used a connecting member including a threaded portion having a major diameter and a minor diameter and a non-threaded lead portion, the length of the lead portion was shorter than the length of the threaded portion, and the diameter of the lead portion was substantially less than the minor diameter of the threaded portion. As a result, there was a loose fit between the lead portion and the bushing threaded opening. Further, the threaded portion did not have a blunt lead. These factors generally contributed to the thread stripping problem.

SUMMARY OF THE INVENTION

One of the principal features of this invention is in the provision of a connector including a connecting member which eliminates the likelihood of this stripping problem.

Another of the principal features of the invention is the provision of such a connector which increases the ease by which a single individual can connect and disconnect a cable connector and a bushing.

This invention provides a connector for electrically connecting a high voltage cable to an electrical apparatus bushing with a threaded opening, the connector comprising a housing having a passage having one end formed to sealingly engage the bushing, and an electrically conductive cable connecting element positioned in the housing and extending partially into the first passage. The cable connecting element is adapted to be electrically connected to the high voltage cable. The connector also includes a bushing connecting member mounted in the passage and adapted to be rotated. The connecting member includes a body portion electrically connected to the cable connecting element, and a threaded portion connected to the body portion and adapted to engage the threaded opening in the bushing. The bushing connecting member also includes a lead portion connected to the threaded portion and having an axial length and a diameter sufficient to insure the maximum amount of possible misalignment between the threaded opening in the bushing and the bushing connecting member is at most about one-half a degree.

In one embodiment, the threaded portion has a major diameter and a minor diameter, and the lead portion has an axial length at least as long as the threaded portion, and a diameter slightly less than the minor diameter of the threaded portion so that there is a small tolerance slip fit between the lead portion and the threaded opening in the bushing.

In one embodiment, the threaded portion has a blunt lead thread and the axial length of the threaded portion is of sufficient length so that the threaded portion engages the bushing opening before the connector housing contacts the bushing.

Various other features and benefits of the invention are more particularly set forth in the attached drawings, the description and the appended claims.

DESCRIPTION OF THE PREFERRED EMBODIMENT

Figures 1, 4, 5, 6:
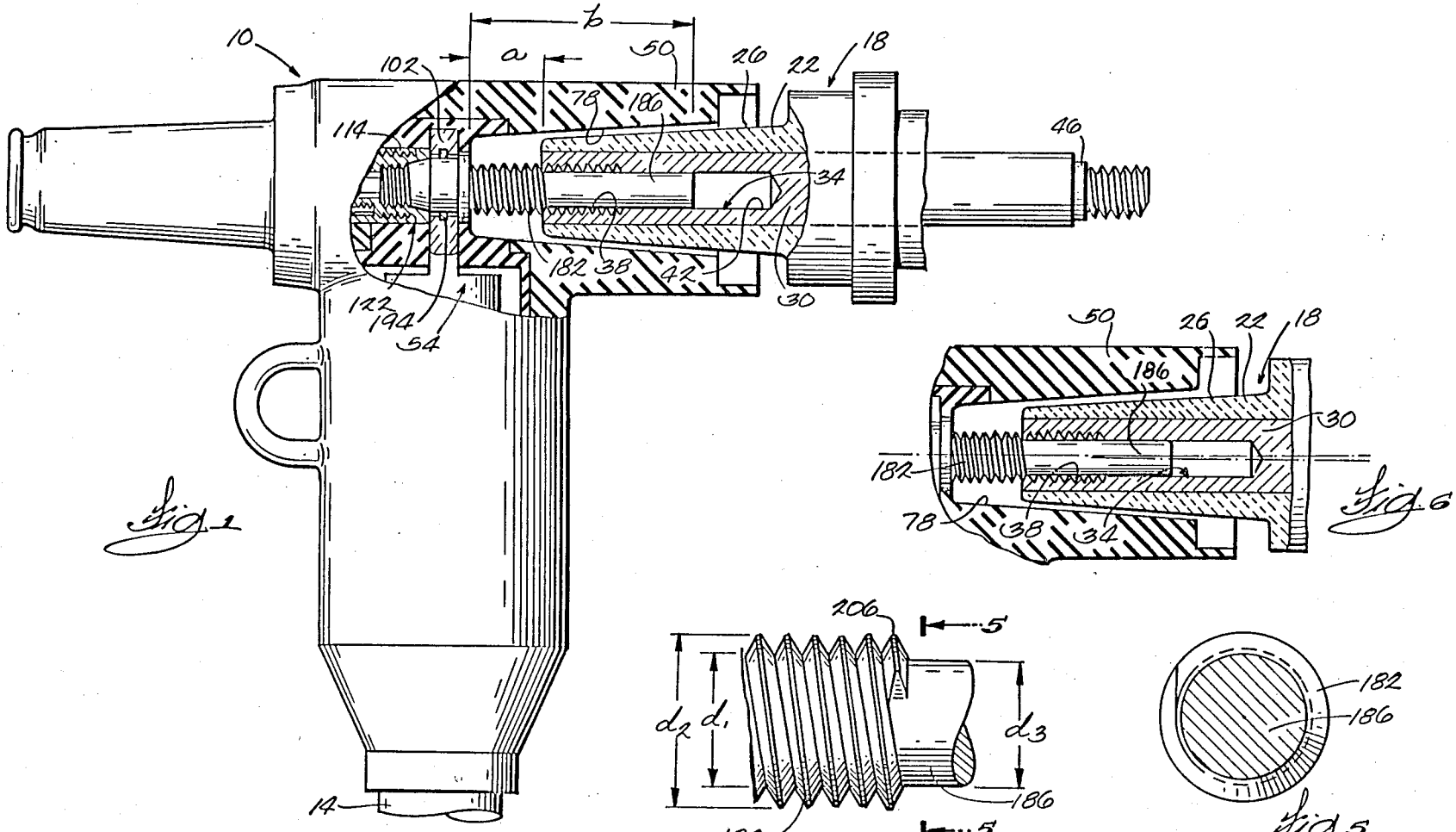
FIG. 1 is a perspective view, partially broken away, of a high voltage cable connector before connection of the connector to an electrical apparatus bushing.
FIG. 4 is an enlarged view of a portion of the connecting member.
FIG. 5 is a cross sectional view of the connecting member taking along the line 5—5 in FIG. 4.
FIG. 6 is another view of the connecting portion shown in FIG. 1 and illustrates the possible misalignment between the bushing connecting member and the bushing opening.

Illustrated in the drawings is a connector 10 for electrically connecting a high voltage cable 14 to an electrical apparatus bushing 18. More particularly, as illustrated in FIG. 1, the connector 10 is a visible break deadfront type T-connector much like that described in U.S. Sankey et al Pat. No. 3,883,208 which issued May 13, 1975 and which is incorporated herein by reference.

The electrical apparatus bushing 18 includes an insulating body or housing 22 having a tapered conical outer surface 26. Centrally located within the bushing housing 22 is an electrical conductor 30 with a blind threaded central opening 34 in one end. Although other constructions can be used in other embodiments, the bushing central opening 34 includes a threaded portion 38 near the one end and a non-threaded portion 42 away from the one end. The other end 46 of the electrical conductor 30 is threaded and adapted to be connected to the wiring inside the electrical apparatus (not shown).

Figure 2:
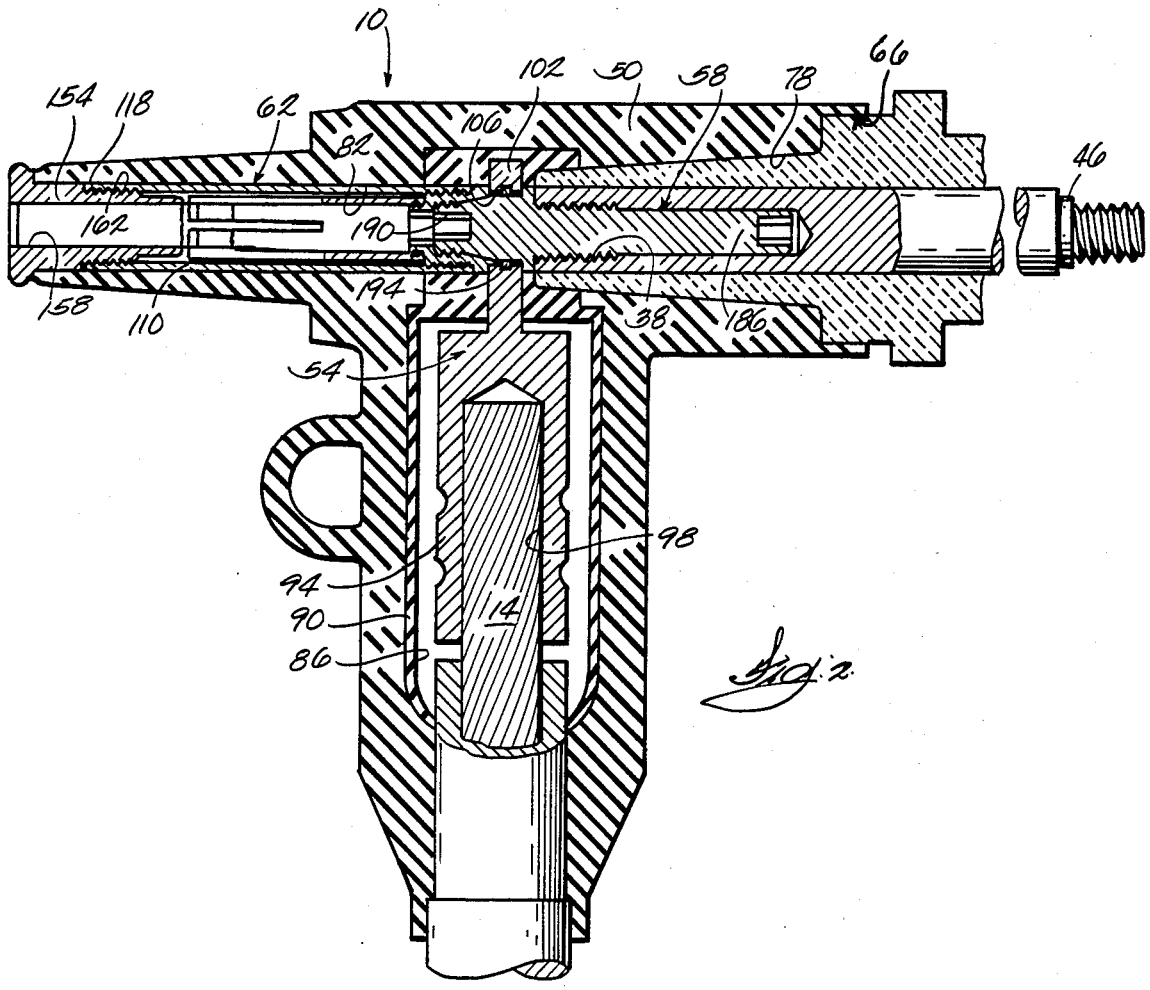
FIG. 2 is a cross sectional view of the high voltage cable connector connected to the electrical apparatus bushing.

As more particularly illustrated in FIG. 2, the connector 10 comprises a housing 50, an electrically conductive cable connecting element 54, a bushing connecting member 58 connected to the cable connecting member 54, and a contact assembly 62. The housing 50 is generally T-shaped, formed from a resilient insulating material such as rubber, and includes a first passage 66 open at both ends and having a tapered section 78 at one end which is adapted to sealingly engage the outer tapered surface 26 of the bushing 18, and a tubular section 82 at the other end. The open ended tubular section 82 provides tool access to rotate the bushing connecting member 58 into the bushing threaded opening 34. The tubular section 82 also houses the contact assembly 62, as explained below. A second cable passage 86 is also provided in the housing 50 and intersects the first passage 66. An electrically conductive elastomeric lining 90 is provided on the surface of the second passage 86 to equalize the voltage gradiant around the electrical connection between the cable connecting element 54 and the bushing connecting member 58.

The high voltage cable 14 is connected to the cable connecting element 54. The connecting element 54 includes a cylindrical portion 94 having a blind bore 98, and an extension or flange 102. The exposed end of the cable 14 is inserted into the blind bore 98 in the cable connecting element 54 and is secured therein by crimping the connecting element 54 to the exposed end of the cable 14.

The connecting element 54 is positioned in the second passage 86 and the connecting element flange 102 extends partially into the first passage 66. The flange 102 also has an opening 106 aligned with the first passage 66.

Figure 3:
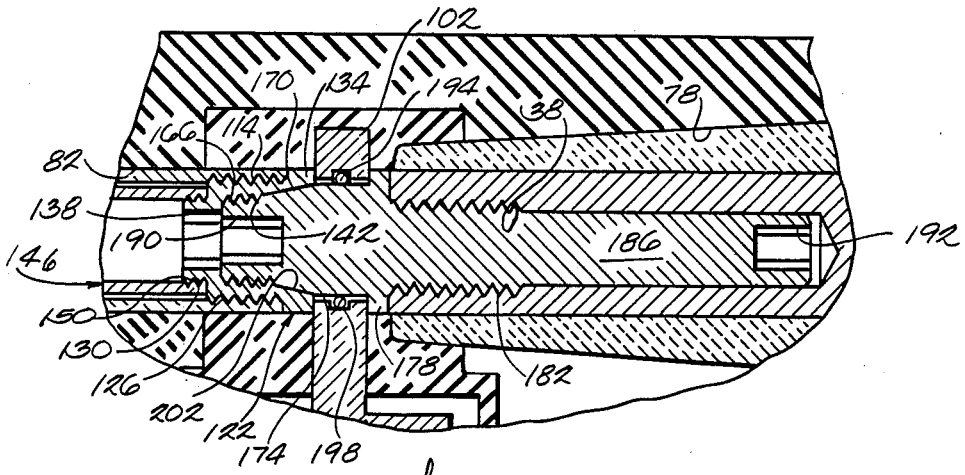
FIG. 3 is an enlarged view of the bushing connecting portion of the high voltage connector.

Received within the flange opening 106 is the bushing connecting member 58. Although other constructions can be used in other embodiments, the bushing connecting member 58 is partially held in place by the contact assembly 62. As illustrated in FIGS. 2 and 3, the contact assembly 62 includes a conductive sleeve 110 having a threaded section 114 at its inner end, and a threaded section 118 at its outer end. A tubular nut 122 having a first outer threaded section 126 and a second outer threaded section 130 is received in the inner end threaded section 114 of the conductive sleeve 110. A flange 134 is provided at the end of the first outer threaded section 126. A hexagonal opening 138 is provided in the nut 122 and an inner threaded section 142 is provided in the center of the nut 122.

As illustrated in FIG. 3, an electrically conductive receptacle 146 having a threaded section 150 at the inner end is mounted on the second outer threaded section 130 of the nut 122. As illustrated in FIG. 2, an arc extinguishing sleeve 154 having an inner bore 158 and an outer threaded section 162 is threadingly received in the conductive sleeve outer end threaded section 118. The open end of the contact assembly 62 can be covered by the means of a cap (not shown) when tool access to the bushing connecting member 58 is not desired.

The bushing connecting member 58 is formed from a solid cylindrical conductive material such as a chromium copper alloy having a fairly high tensile strength. Although other constructions can be used in other embodiments, the connecting member 58 includes, as viewed from left to right in FIG. 3, a first threaded portion 166, a tapered portion 170, a central or body portion 174, a flange 178, a seconded threaded portion 182, and a lead portion 186. Hexagonal openings 190 and 192 of the same size are provided at each end of the bushing connecting member 58.

The body portion 174 is located within the cable connecting element opening 106 and the diameter of the connecting member body portion 174 is slightly smaller than the diameter of the opening 106 in the cable connecting element flange 102. Electrical communication is provided between the member 58 and the cable connecting element 54 by means of a conductive ring 194 provided in a groove 198 in the cable connecting element 54. The conductive ring 194 has an inner diameter slightly smaller than the outer diameter of the body portion 174 of the connecting member 58.

The first threaded section 166 of the connecting member 58 is adapted to be received within the inner threaded section 142 of the nut 122. Also, the hexagonal opening 138 in the nut 122 is larger than the hexagonal opening 190 in the connecting member 58. The nut 122 also includes a tapered section 202 provided at the end of the nut first threaded section 166 which corresponds with the tapered portion 170 of the connecting member 58.

The bushing connecting member 58 is assembled to the cable connecting element 54 by mounting the nut 122 on the connecting member 58. The connecting member flange 178 and the nut 122 are slightly spaced from the cable connecting element flange 102 to provide a fixed space slightly larger than the width of the flange 178 to allow the connecting member 58 to rotate freely in the cable connecting element opening 106.

The second threaded portion 182 connected to the body portion 174 is adapted to engage the threaded opening 34 in the bushing 18. This second threaded portion 182 has a major diameter ($d_2$) corresponding to the outer, dimension of the crest of the threads and a minor diameter ($d_1$) corresponding to the inner dimension of the valleys between the threads.

As illustrated in FIG. 6, the non-threaded lead portion 186 is connected to the second threaded portion 182 and has an axial length and a diameter sufficient to insure the maximum amount of possible misalignment between the longitudinal axis of the bushing opening 34 and the longitudinal axis of bushing connecting member 58 is at most about one-half a degree. A longer lead portion 186 can be used when a greater clearance is present between the lead portion 186 and the bushing opening 34, and a shorter lead portion 186 can be used when less clearance is present between the lead portion 186 and the bushing opening 34. In this particular embodiment, the lead portion 186 has an axial length at least as long as the second threaded portion 182. The non-threaded lead portion 186 also has a diameter ($d_3$) slightly less than the minor diameter ($d_2$) of the second threaded portion 182 so that there is a small tolerance slip fit (between 0.001 inch and 0.015 inch) between the lead portion 186 and the threaded opening 34 in the bushing 18.

Further, as illustrated in FIGS. 4 and 5, the second threaded portion 182 has a blunt lead thread 206. The lead thread 206 has been cut at about the top of the crest so that the crest of the thread 206 engages immediately with the mating threads in the bushing opening 34. The typical fine lead thread which extends gradually down between the crest of the thread and the outer surface of the lead portion 186 has thus been eliminated. The elimination of this gradually reducing lead thread greatly reduces the likelihood of stripping the lead thread. As illustrated in FIG. 5, the leading edge of the lead thread 206 is generally tangential to the outer surface of the lead portion 186.

As illustrated in FIG. 1, an optimum axial length (a) of the second threaded portion 182 has been found to be between $\frac{7}{8}$ and $1\frac{3}{8}$ inches and an optimum axial length (b) of the second threaded portion 182 and the non-threaded lead portion 186 has been found to be between $2\frac{3}{8}$ and $3\frac{1}{4}$ inches. The second threaded portion length used by the applicants is 1 inch and a 2.8 inch length is used for the combined second threaded portion 182 and lead portion 186.

The length of the second threaded portion 182 has been determined to be one which, as illustrated in FIG. 2, permits engagement of the second threaded portion with the bushing threaded opening 34 without initiating contact between the bushing housing 22 and the connector housing 50. This permits initial engagement of the connecting member 58 in the bushing threaded opening 34 without the person rotating the bushing connecting member 58 having to fight against a resilient contact between the connector housing and the bushing housing 22.

The long lead portion 186 being sized for a slip fit into the bushing opening 34 provides a positive means of aligning the threads of the connecting member 58 and the bushing 18. The increased length of the connector threads allows for thread engagement before the interference of the interfaces between the bushing housing 22 and the connector housing 50. The blunt lead thread 206 of the connecting member threads makes the threads easier to engage and makes cross-threading highly unlikely. The blunt start also eliminates the thin thread form typical of most thread starts. A thin thread form can be easily bent or rolled over.

The improved connector 10 including the above described bushing connecting member 58 permits connection of the connector 10 to the bushing 18 to be more easily achieved by a single person while two persons were typically required to connect bushings and connector in earlier designs.

Various other features of the invention are set forth in the following claims.

We claim:

1. A connector for electrically connecting a high voltage cable to an electrical apparatus bushing with a threaded opening, said connector comprising a housing having a passage having one end formed to sealingly engage the bushing, an electrically conductive cable connecting element positioned in said housing and extending partially into said passage, said cable connecting element being adapted to be electrically connected to the high voltage cable, and a bushing connecting member mounted in said passage and adapted to be rotated and including a body portion electrically connected to said cable connecting element, a threaded portion connected to said body portion and adapted to engage the threaded opening in the bushing, said threaded portion having a major diameter and a minor diameter, and a lead portion connected to said threaded portion and having an axial length at least as long as said threaded portion, and a diameter slightly less than said minor diameter of said threaded portion so that there is a small tolerance slip fit between said lead portion and the threaded opening in the bushing.

2. A connector in accordance with claim 1 wherein said difference between said lead portion diameter and said threaded portion minor diameter is between 0.001 inch and 0.015 inch.

3. A connector in accordance with claim 1 wherein the axial length of said threaded portion is of sufficient length so that said threaded portion engages said threaded opening of the bushing before said housing contacts the bushing.

4. A connector in accordance with claim 1 wherein said lead portion is non-threaded.

5. A connector in accordance with claim 1 wherein said threaded portion has a blunt lead thread.

6. A connector in accordance with claim 5 wherein the axial length of said threaded portion is between $\frac{7}{8}$ and $1\frac{3}{8}$ inches and wherein the axial length of said threaded portion and said lead portion is between $2\frac{3}{8}$ and $3\frac{1}{4}$ inches.

7. A connector for electrically connecting a high voltage cable to an electrical apparatus bushing with a threaded opening, said connector comprising a housing formed from an insulating material and having a first passage having one end formed to sealingly engage the bushing and a second passage intersecting said first passage, an electrically conductive cable connecting element positioned in said second passage and extending partially into said first passage, said cable connecting element being adapted to be electrically connected to the high voltage cable and having an opening axially aligned with said first passage, and a bushing connecting member located in said first passage and adapted to be rotated and including a body portion positioned in and in electrical communication with said cable connecting element opening, a threaded portion connected to said body portion and adapted to engage the threaded opening in the bushing, said threaded portion having a major diameter and a minor diameter, and a non-threaded lead portion connected to said threaded portion and having an axial length at least as long as said threaded portion and a diameter slightly less than said minor diameter of said threaded portion so that there is a small tolerance slip fit between said lead portion and the threaded opening in the bushing.

8. A connector in accordance with claim 7 wherein said difference between said lead portion diameter and said threaded portion minor diameter is between 0.001 inch and 0.015 inch.

9. A connector in accordance with claim 7 wherein the axial length of said threaded portion is of sufficient length that said threaded portion engages said threaded opening of the bushing before said housing contacts the bushing.

10. A connector in accordance with claim 7 wherein said threaded portion has a blunt lead thread.

11. A connector in accordance with claim 10 wherein the axial length of said threaded portion is between $\frac{7}{8}$ and $1\frac{3}{8}$ inches and wherein the axial length of said threaded portion and said non-threaded lead portion is between $2\frac{3}{8}$ and $3\frac{1}{4}$ inches.

12. A connector, for electrically connecting a high voltage cable to an electrical apparatus bushing with a threaded opening, said connector comprising a housing having a passage having one end formed to sealingly engage the bushing, an electrically conductive cable connecting element positioned in said housing and extending partially into said passage, said cable connecting element being adapted to be electrically connected to the high voltage cable, and a bushing connecting member mounted in said passage and adapted to be rotated and including a body portion electrically connected to said cable connecting element, a threaded portion connected to said body portion and adapted to engage the threaded opening in the bushing, and a lead portion connected to said threaded portion and having an axial length and a diameter sufficient to insure the maximum amount of possible misalignment between the threaded opening in the bushing and said bushing connecting member is at most about one-half a degree.

13. A connector in accordance with claim 12 wherein said threaded portion has a major diameter and a minor diameter, and said lead portion has an axial length at least as long as said threaded portion, and a diameter slightly less than said minor diameter of said threaded portion so that there is a small tolerance slip fit between said lead portion and the threaded opening in the bushing

14. A connector in accordance with claim 12 wherein said threaded portion has a blunt lead.

* * * * *